US006598297B1

(12) United States Patent
Matt

(10) Patent No.: US 6,598,297 B1
(45) **Date of Patent: *Jul. 29, 2003**

(54) COMBINATION KNIFE, TURNING HOOK AND BOTTLE DE-CAPPER, WITH ANIMAL SHAPE

(76) Inventor: Shane Michael Matt, 1251 Rue des Etoiles, Carencro, LA (US) 70520

( * ) Notice: Subject to any disclaimer, the term of this patent is extended or adjusted under 35 U.S.C. 154(b) by 0 days.

This patent is subject to a terminal disclaimer.

(21) Appl. No.: 09/968,593

(22) Filed: Oct. 1, 2001

(51) Int. Cl.[7] ..... B26B 11/00; B67B 7/00
(52) U.S. Cl. ..... 30/142; 30/353; 7/151
(58) Field of Search ..... 30/147, 142, 353, 30/136; 7/148, 156, 158, 159, 151, 161; D7/649–652; D8/33

(56) References Cited

U.S. PATENT DOCUMENTS

| | | | | | |
|---|---|---|---|---|---|
| 132,996 | A | * | 11/1872 | Weaver | 7/145 |
| 853,367 | A | * | 5/1907 | Malory | 30/314 |
| 921,988 | A | * | 5/1909 | Heath | 7/118 |
| D43,268 | S | * | 11/1912 | Cary | D11/157 |
| D47,778 | S | * | 8/1915 | Yapczenski | 7/155 |
| D50,381 | S | * | 2/1917 | Funk | D8/18 |
| 1,572,289 | A | * | 2/1926 | Hogan | 7/161 |
| 2,010,326 | A | * | 8/1935 | Schuchardt | 81/3.35 |
| D99,976 | S | * | 6/1936 | Lesti et al. | D8/18 |
| 2,103,008 | A | * | 12/1937 | Kinast | 254/21 |
| D109,996 | S | * | 6/1938 | Baer | D7/651 |
| D117,768 | S | * | 11/1939 | Casebeer | D8/38 |
| 2,285,386 | A | * | 6/1942 | Atwood | 30/314 |
| D139,187 | S | * | 10/1944 | Wagner | D7/650 |
| D152,727 | S | * | 2/1949 | Peterson | 30/279.2 |
| 2,546,728 | A | * | 3/1951 | Dell | 30/121 |
| D168,020 | S | * | 10/1952 | Davis, Jr. | D8/18 |
| 2,635,337 | A | * | 4/1953 | Mercy | 30/353 |
| D184,822 | S | * | 4/1959 | Mann | D8/38 |
| 3,162,475 | A | | 12/1964 | Van Allen | |
| 3,241,236 | A | * | 3/1966 | Capps | 30/287 |
| D212,196 | S | * | 9/1968 | Pasquale | 30/321 |
| D220,463 | S | * | 4/1971 | Pugh, Sr. | D7/651 |
| D229,533 | S | * | 12/1973 | Pugh | D22/118 |
| D229,883 | S | * | 1/1974 | Pugh | D22/118 |
| 4,168,856 | A | * | 9/1979 | Rhoades | 294/8 |
| D253,989 | S | | 1/1980 | Rhoades | |
| 4,283,854 | A | * | 8/1981 | Austin | 30/317 |
| D268,561 | S | | 4/1983 | Risser | |
| D268,639 | S | * | 4/1983 | Johannsen | D7/650 |
| D273,075 | S | | 3/1984 | Hayden | |
| 4,734,984 | A | | 4/1988 | Snell et al. | |
| D296,577 | S | * | 7/1988 | Schandua | D22/118 |
| 4,787,146 | A | * | 11/1988 | Gaskins | 30/351 |
| D315,661 | S | * | 3/1991 | Scheuerman | D7/693 |
| D353,687 | S | * | 12/1994 | Dacko | D21/599 |
| D371,060 | S | * | 6/1996 | Lai | D8/107 |
| D376,091 | S | * | 12/1996 | Heglin | D8/98 |

(List continued on next page.)

*Primary Examiner*—Allan N. Shoap
*Assistant Examiner*—Jason Prone
(74) *Attorney, Agent, or Firm*—Jesse D. Lambert

(57) ABSTRACT

A combination food preparation and handling tool comprises a handled main blade body, a turning hook, and a pair of legs protruding from the main blade body. In the preferred embodiment, the turning hook is integrally formed from an extended and pointed tip of the main blade body formed into the desired shape and bent at an angle to the main blade body. One edge of the main blade body is preferably arcuate in shape and sharpened to form a primary cutting edge. The legs can form a bottle de-capper and a secondary cutting edge. The preferred arrangement of the main blade body, the turning hook and the legs forms a likeness of a legged animal, such as an alligator. Further enhancement of the animal appearance may be had through etchings or engravings on the main blade body to represent other features of the animal.

9 Claims, 5 Drawing Sheets

U.S. PATENT DOCUMENTS

D389,719 S * 1/1998 O'Hara et al. ..... D8/100
5,774,921 A * 7/1998 Harrison et al. ..... 15/145
5,813,120 A * 9/1998 Stroh ..... 30/123
D399,116 S * 10/1998 Gullette ..... D8/100
D399,404 S * 10/1998 Gullette ..... D8/100
D403,942 S * 1/1999 Gullette ..... D8/100
5,896,668 A * 4/1999 Murrell ..... 30/322
D412,427 S * 8/1999 Prissberg ..... D7/651
D412,647 S * 8/1999 Prissberg ..... D7/651
6,009,581 A * 1/2000 Davis et al. ..... 7/105
D425,379 S 5/2000 Clausen
6,070,329 A * 6/2000 Gibbs ..... 30/344
6,105,254 A * 8/2000 Crane et al. ..... 30/128
D438,443 S * 3/2001 Keating ..... D8/99
D440,125 S * 4/2001 Barker, II ..... D7/651
D445,314 S * 7/2001 Barker, II ..... D7/651
D445,661 S * 7/2001 Chen ..... D21/599
6,256,887 B1 * 7/2001 Osborne ..... 30/159
D451,572 S * 12/2001 Barker, II ..... D22/118
D452,547 S * 12/2001 Barker, II ..... D22/118
6,429,851 B1 * 8/2002 Vaghefi et al. ..... D14/402
D465,703 S * 11/2002 Matt ..... D7/651
D473,623 S * 4/2003 Rae ..... D7/651
D473,924 S * 4/2003 Rae ..... 30/151

* cited by examiner

COMBINATION KNIFE, TURNING HOOK AND BOTTLE DE-CAPPER, WITH ANIMAL SHAPE

BACKGROUND

1. Field of the Invention

This invention relates to tools used to prepare and serve various foods, especially suited to meats and fowls. More particularly, this invention relates to a novel apparatus which combines a knife and a turning hook in a single, easily used apparatus, and in one preferred embodiment does so in a novel arrangement resembling a legged creature such as an alligator. The invention may further embody a bottle de-capper and a hooked secondary cutting edge.

2. Related Art

Many different tools have been developed to handle foods, both in preparation and serving of same. Spoons and ladles are used for liquids or flowable foods such as soups and stews. Devices such as spatulas are used to turn over and lift meats, vegetables, fried eggs and the like. Forks are used to pierce and to manipulate various foods, particularly but not exclusively meats. Yet another device is a turning hook, which in a commonly seen configuration is a single pronged device with a sharply pointed end, formed into a curl and bent at an angle to the main shaft. Such turning hooks are especially convenient for turning and lifting meats and fowls, especially when grilling such foods, for example on an outdoor barbecue. An example of such turning hooks is shown in U.S. Pat. No. Des. 273,075 to Hayden, Mar. 20, 1984. Such turning hooks, in lieu of the use of a spatula or a conventional fork, permit a more secure and easier manner of impaling and lifting the meat, as the relatively tightly curled hook (substantially at a right angle to the main shaft) is rotated into the meat and then the tool (with the meat attached) can be picked straight up. Turning hooks generally permit the user to keep his or her hand away from a position substantially directly over the meat being picked up and turned, as conventional forks generally require.

Of course, knives of many sizes and shapes are used to cut foods, particularly but not exclusively meats such as beef or pork steaks and roasts, fowls such as chickens and turkeys, and fish. In addition to the common configuration of knives having elongated cutting edges, knives having relatively small, notched or curved cutting edges have been developed. Such knives often have the cutting edge formed by a sharp edged "hook" protruding from the main blade body, and are used by hooking the blade into the foodstuff to be cut then pulling the blade toward the user.

Still another cooking or kitchen-related tool is a bottle de-capper for prying the caps off of bottles containing beverages, cooking marinades, wines and the like. Such bottle de-cappers, while taking a number of different forms, generally comprise a handled device having a prong, lip, or other protrusion which can be hooked under a bottle cap, then the handle manipulated (usually by rotating the handle upward or downward) to leverage the cap off of the bottle.

However, the related art known to applicant does not disclose a single tool with a knife having a primary cutting edge, in combination with a turning hook, and in alternative embodiments further combining a bottle de-capper and a curved or hook shaped secondary cutting edge. Further still, the known related art does not disclose a single tool combining a knife and a turning hook at the tip of the knife and forming the likeness of a legged animal, the legs of said animal likeness forming the bottle de-capper and the secondary cutting edge.

SUMMARY OF THE INVENTION

The present invention is a food preparation and serving tool comprising, in combination, a main blade body with a primary cutting edge, a handle at one end and a turning hook at the opposite end. In the preferred embodiment, the primary cutting edge is a generally arcuate, sharpened surface, the end of the main blade body opposite the handle has an extended and tapered tip, and the turning hook is formed by bending the extended tip around to a position more or less at right angle to the main blade body, and curling or turning up the end of the tip. The preferred embodiment further comprises at least two legs on the edge of the main blade body opposite the primary cutting edge. The main blade body, extended and tapered tip, and the legs together form, in the preferred embodiment, a likeness of a legged animal. The legs may comprise a bottle de-capper formed into one leg and a curved or hook-shaped secondary cutting edge formed into another leg. While likenesses of different animals may be formed, in one preferred embodiment an alligator likeness is formed.

DESCRIPTION OF PRESENTLY PREFERRED EMBODIMENTS

The present invention is a food preparation and handling tool, comprising a main blade body comprising a first end comprising a handle, a second end comprising a turning hook, wherein said turning hook comprises an upwardly turned point disposed at an angle with said main blade body, and a primary cutting edge formed on one edge of said main blade body. With reference to the drawings, one presently preferred embodiment is now described.

The apparatus 10 comprises an elongated main blade body 30 having a handle 20 at a first end, for convenient gripping by the user. Main blade body 30 further comprises a primary cutting edge 40. While primary cutting edge 40 may have a number of profile shapes, primary cutting edge 40 is preferably arcuate, as is described further herein. Primary cutting edge 40 is sharpened to a sufficient degree to permit easy cutting and slicing of foods such as meats.

Figure 6:
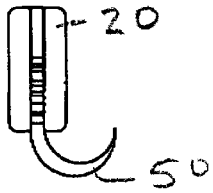
FIGS. 6 and 7 are opposing end views of the invention.
Figure 7:
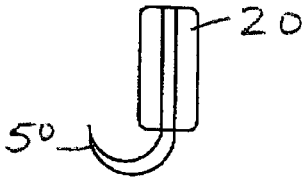
Figure 8:
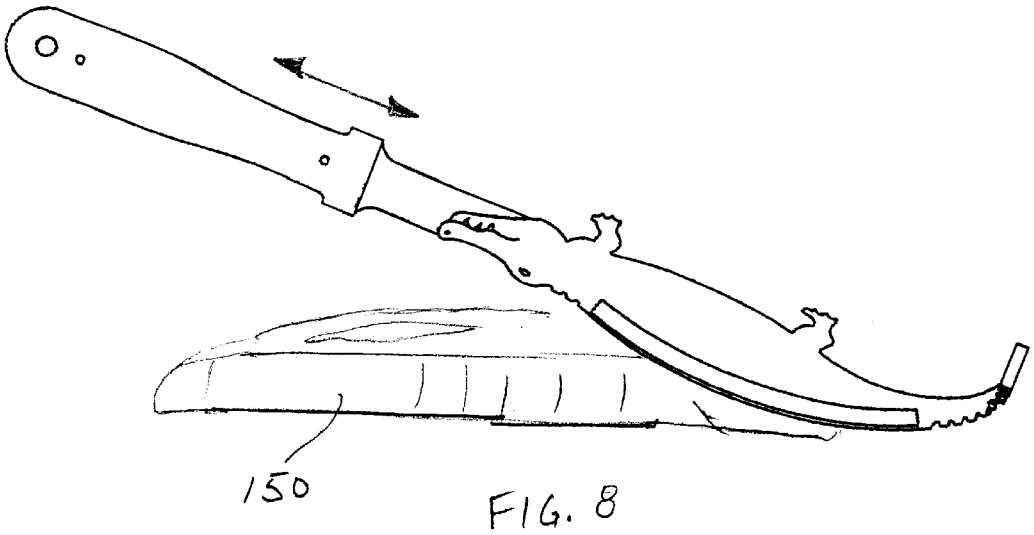
FIG. 8 is a side view of the invention being employed to cut a piece of meat.
Figure 9:
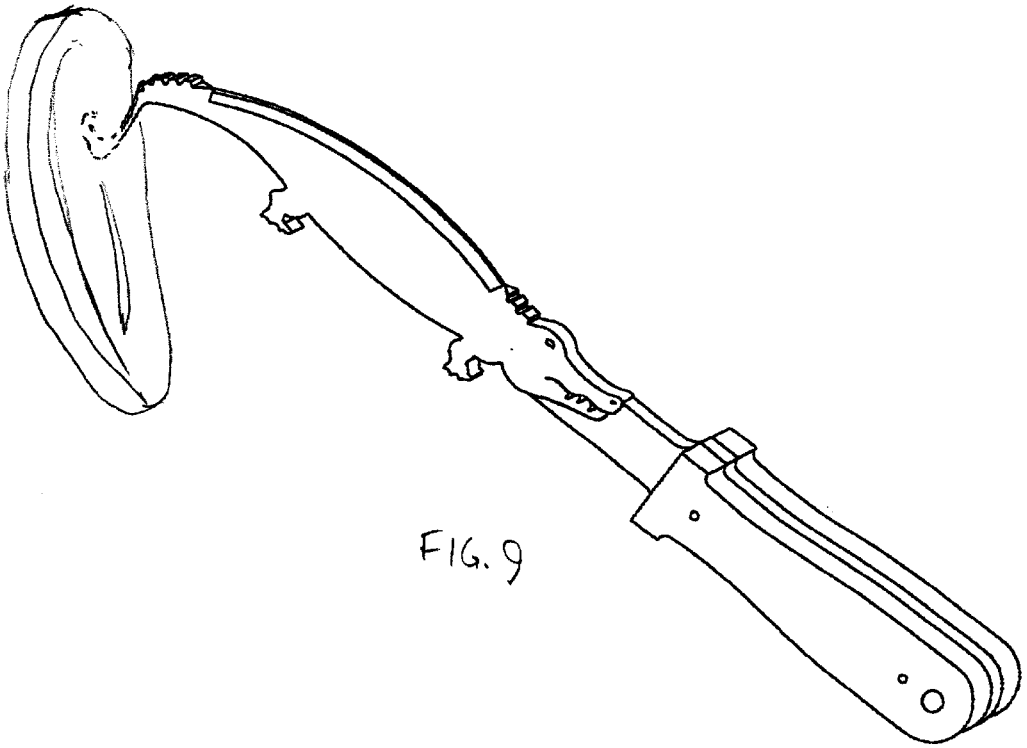
FIG. 9 is a view of the invention being used to pick up a piece of meat with the turning hook.

A second end of main blade body 30 comprises a turning hook 50. In the preferred embodiment, said second end of main blade body 30 terminates in an extended and pointed tip, and turning hook 50 is integrally formed with main blade body 30 by bending the extended and pointed tip to an angle with respect to main blade body 30, preferably at substantially a right angle, as best shown in FIGS. 1 through 5. The extended and pointed tip curls upward to form turning hook 50, as perhaps most easily seen in FIGS. 1, 6 and 7. FIG. 8 illustrates use of the primary cutting edge 40 to slice a steak 150, and FIG. 9 shows use of turning hook 50 to pick up steak 150.

Figure 1:
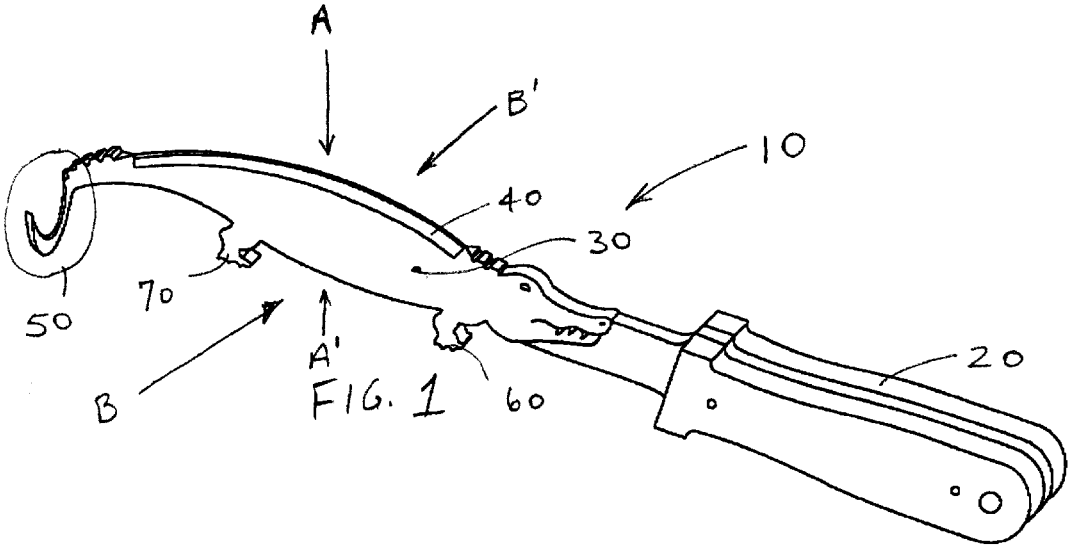
FIG. 1 is a perspective view of one embodiment of the present invention.
Figure 4:
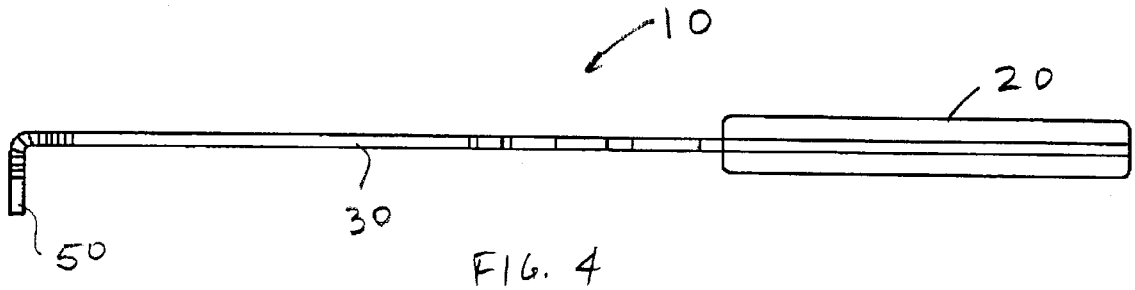
FIG. 4 is a top view, in the direction shown by arrow A in FIG. 1.
Figure 5:
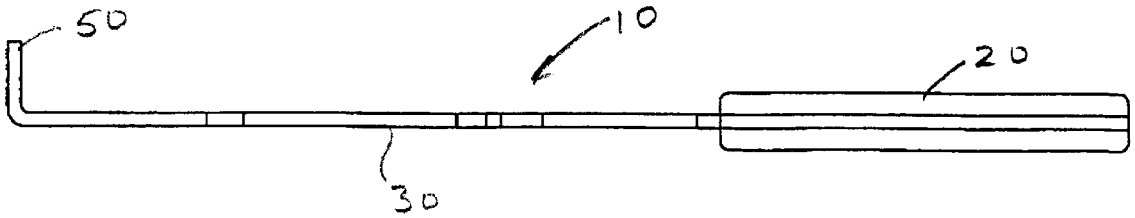
FIG. 5 is a bottom view in the direction of arrow B' in FIG. 1.
Figure 11:
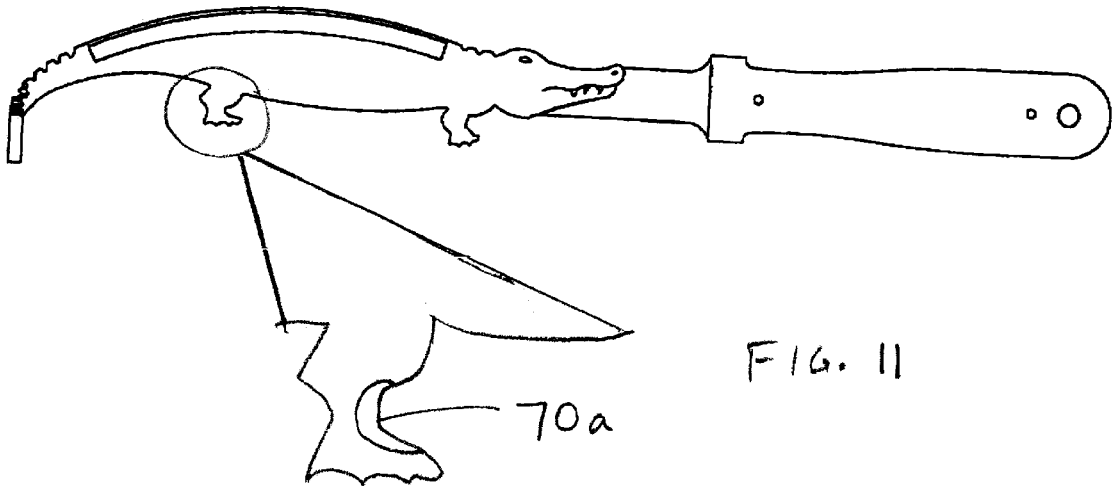
FIG. 11 is a close up view of the hooked, secondary cutting edge.
Figure 10:
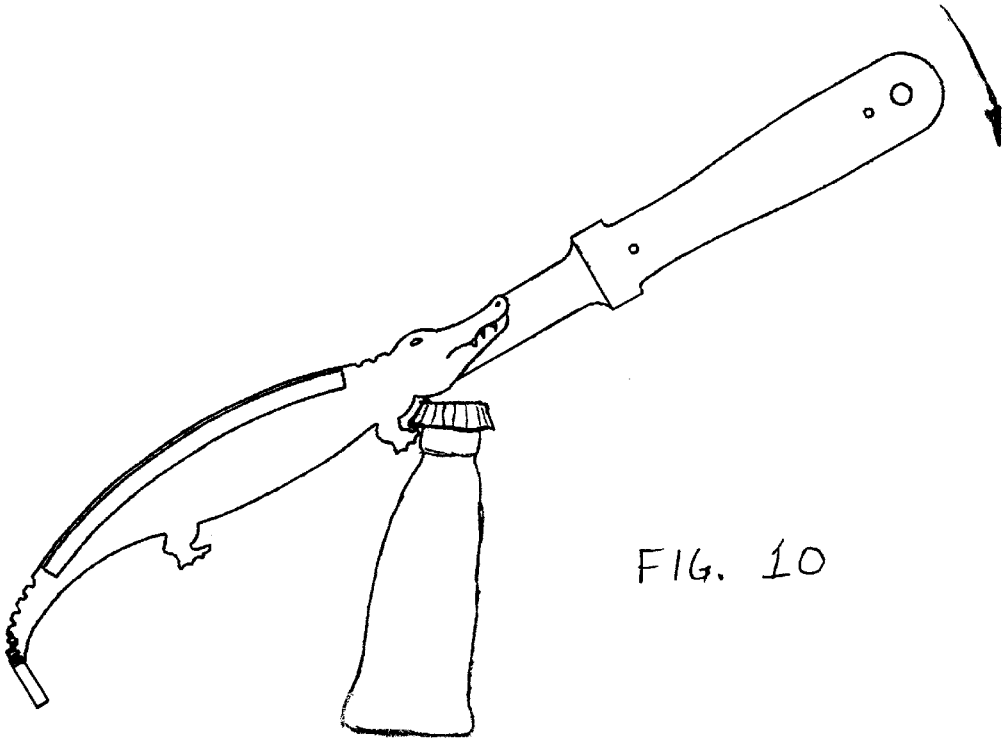
FIG. 10 shows the invention being used as a bottle de-capper.

The present invention further preferably comprises at least one, and preferably two, legs 60 and 70 extending from the edge of the main blade body opposite primary cutting edge 40, as best seen in FIGS. 1, 4 and 5. Leg 60 is shaped and adapted so as to form a bottle de-capper, in combination with the main body 30. FIG. 10 shows use of the invention as a bottle de-capper. Leg 70 may comprise a hooked, secondary cutting edge 70*a*, shown in detail in FIG. 11, by sharpening one edge of leg 70. It is understood that while a preferred arrangement of bottle de-capper and secondary cutting edge 70*a* is formed from leg 60 and 70, respectively, the scope of the invention includes the reverse, that is, leg 60 comprising a secondary cutting edge and leg 70 forming the bottle de-capper.

Figure 2:
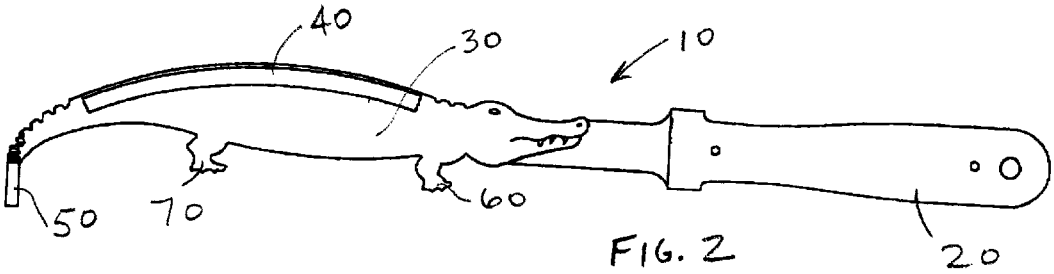
FIG. 2 is a side view of the invention, in the direction shown by arrow B in FIG. 1.
Figure 3:
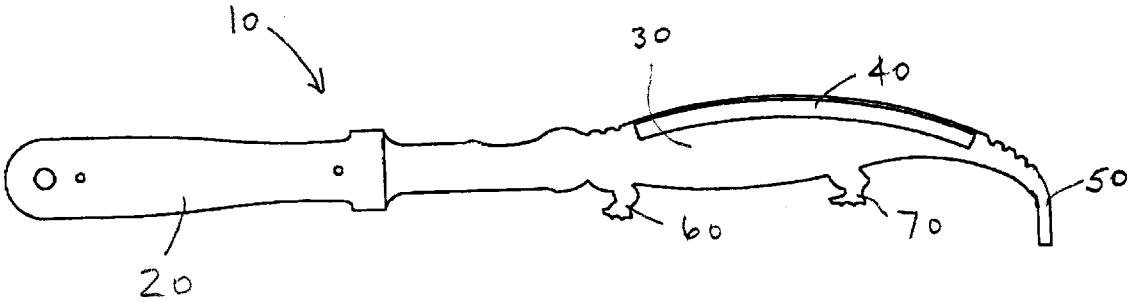
FIG. 3 is a side view, in the direction shown by arrow B' in FIG. 1.

Another point of novelty of the present invention arises out of the combination of the various elements described above, into a design wherein a likeness of a legged animal is created. FIGS. 1–3 show one presently preferred embodiment wherein the various elements are combined to form the likeness of an alligator. Other animal shapes are possible as well, by way of example only a tiger, an armadillo, a razorback hog, fish, dinosaurs and the like. Further enhancement of the apparatus to depict an animal is from markings on main blade body 30 to represent various features of the animal, as shown in the drawings. The markings are preferably by a permanent means, such as laser etching or engraving which permanently marks the surface of the blade. Other means of forming the features such as conventional engraving, stamping and the like could also be used.

Figure 12:
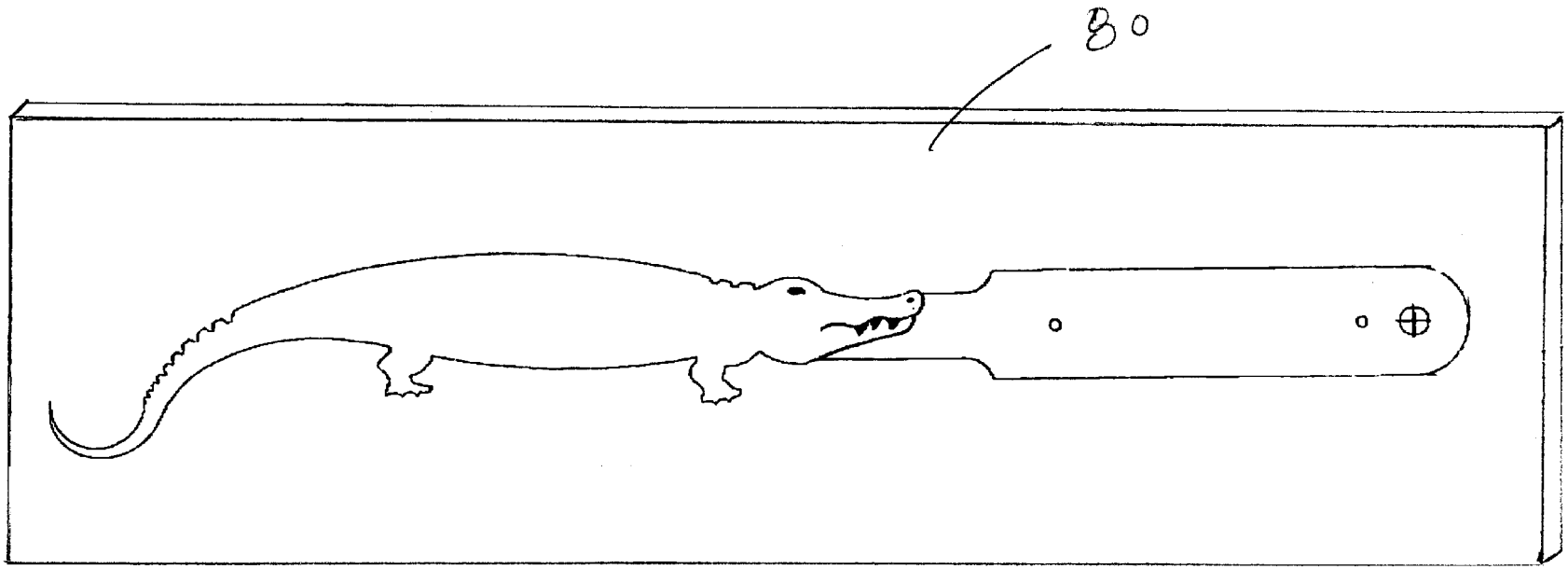
FIG. 12 is a view of one embodiment outlined on flat stock, prior to cutting out.

In the preferred embodiment, the present invention is advantageously formed by first forming the profile of the main blade body, legs, and extended and pointed tip in a piece of flat sheet material 80, such as stainless steel, as shown in FIG. 12, by stamping or cutting out the profile via a laser or other cutting means. The animal features may be inscribed onto the main blade surface at this time. Primary cutting edge 40 is ground and/or honed onto main blade body 30, and the extended and pointed tip bent over to a position at an angle to the main blade, preferably substantially at a right angle, thereby forming turning hook 50. Handle 20, which may be of wood, plastic or other handle materials well known in the art, can then be attached by rivets, adhesive, or other means known in the art.

Alternatively, the present invention could be made by casting main blade body 30 and turning hook 50 in their ultimate angled relationship. Still another method of manufacture within the scope of the invention would be to form main blade body 30 and turning hook 50 from two separate pieces of material, then attaching turning hook 50 to main blade body 30 by riveting, welding, or other means known in the art.

While the ensuing description contains many specificities, it is understood that same are offered by way of example and not limitation. For example, the dimensions and shapes of the various components of the invention could be varied as desired. By changing relative sizes and shapes, the likenesses of different animals could be formed, by way of example only cattle, canines, felines, etc. Different materials could be used for the main blade body, especially different alloys of steels to secure desired manufacturing and cutting properties. The handle could be formed of a variety of suitable materials and in a number of suitable shapes.

Therefore, the scope of the invention should be determined by the appended claims and their legal equivalents, rather than by the examples given.

I claim:

1. A combination food preparation and handling tool depicting a legged animal, comprising:

a) a main blade body having opposing ends and opposing side surfaces, a major portion of said main blade body being in a single plane, a handle being attached at one end, the other end having a semi-circular curved and pointed hook;

b) said hook being connected to said major portion by a transitional curved portion having opposing side surfaces which said opposing side surfaces of said major portion extend into so that one side surface of said transitional portion is concave and the other side surface is convex, said main blade body further comprising a top edge and a bottom edge;

c) at least two legs extending from said bottom edge of said main blade body opposite said primary cutting edge, said hook having a first section connected to said transitional portion that extends in the same direction as said legs, wherein said main blade body, said semi-circular curved and pointed hook, and said legs form a likeness of a legged animal.

2. The tool of claim 1, wherein at least one said legs is shaped and adapted to hook over the edge of a bottle cap on a bottle, whereby rotating said toll pries said bottle cap off of said bottle.

3. The tool of claim 1, wherein at least one said legs comprises a hooked secondary cutting edge.

4. The tool of claim 1, further comprising markings on said main blade body depicting attributes of said legged animal.

5. The tool of claim 4, wherein said legged animal is an alligator.

6. The tool of claim 1, wherein said legged animal is an alligator.

7. The tool of claim 2, wherein at least one of said legs comprises a hooked secondary cutting edge.

8. The tool of claim 7, further comprising markings on said main blade body depicting attributes of said legged animal.

9. The tool of claim 8, wherein said legged animal is an alligator.

* * * * *